US009752324B2

(12) United States Patent
Leitch

(10) Patent No.: US 9,752,324 B2
(45) Date of Patent: Sep. 5, 2017

(54) ROOFING SHINGLE SYSTEM AND SHINGLES FOR USE THEREIN

(71) Applicant: Building Materials Investment Corporation, Dallas, TX (US)

(72) Inventor: Olan Leitch, Bakersfield, CA (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/656,886

(22) Filed: Mar. 13, 2015

(65) Prior Publication Data

US 2016/0265229 A1 Sep. 15, 2016

(51) Int. Cl.

| | |
|---|---|
| ***E04D 1/26*** | (2006.01) |
| ***E04D 5/12*** | (2006.01) |
| ***E04D 1/30*** | (2006.01) |
| *E04D 1/00* | (2006.01) |

(52) U.S. Cl.

CPC ..... *E04D 1/26* (2013.01); *E04D 1/30* (2013.01); *E04D 5/12* (2013.01); *E04D 2001/005* (2013.01)

(58) Field of Classification Search

CPC ..... E04D 1/26; E04D 2001/005; E04D 1/00; E04D 1/30; E04D 5/12

See application file for complete search history.

(56) References Cited

U.S. PATENT DOCUMENTS

| | | | | | |
|---|---|---|---|---|---|
| 1,243,064 | A | * | 10/1917 | Heppes | 52/557 |
| 1,326,899 | A | * | 1/1920 | Abraham | 52/559 |
| 1,402,361 | A | * | 1/1922 | Hose | 52/532 |
| RE15,280 | E | * | 2/1922 | Abraham | 52/559 |
| 1,412,295 | A | * | 4/1922 | Speer | 52/559 |
| 1,415,758 | A | * | 5/1922 | Abraham | 83/682 |
| 1,442,614 | A | * | 1/1923 | Hooker | 52/523 |
| 1,445,161 | A | * | 2/1923 | Ott | 52/527 |
| 1,473,919 | A | * | 11/1923 | Abraham | 52/555 |

(Continued)

OTHER PUBLICATIONS

CertainTeed Shingle Applicator's Manual: Presidential Shake and Presidential Shake TL, http://www.certainteed.com/resources/PresidentialShakeTLInstall.pdf (undated).

*Primary Examiner* — Adriana Figueroa
*Assistant Examiner* — Jessie Fonseca
(74) *Attorney, Agent, or Firm* — Fitzpatrick, Cella, Harper & Scinto

(57) ABSTRACT

A roofing shingle is provided comprising a reduced-with headlap portion including headlap projections, a buttlap portion including buttlap projections, a lateral leading edge, and a lateral trailing edge, wherein the headlap projection nearest the lateral leading edge has an increased breadth. A roofing system is also provided comprising a multiplicity of courses of shingles of the invention, wherein a lateral trailing edge of a shingle in a single course overlaps (side-laps) an adjacent previously installed shingle, and wherein a shingle in a subsequent course provides a generally uniform overlap region over the headlap portions of a first and second adjacent shingle in the first course and an expanded overlap region over the second adjacent shingle, wherein the expanded overlap region is due to the increased breadth of the headlap projection nearest the lateral leading edge of the second adjacent shingle in the first course.

23 Claims, 6 Drawing Sheets

(56) References Cited

U.S. PATENT DOCUMENTS

| | | | | | |
|---|---|---|---|---|---|
| 1,475,551 | A | * | 11/1923 | Overbury | 83/41 |
| 1,511,732 | A | * | 10/1924 | Kromenaker et al. | 52/523 |
| 1,688,917 | A | | 10/1928 | Busha | |
| 1,700,774 | A | * | 2/1929 | Rahr et al. | 428/623 |
| 1,732,403 | A | | 10/1929 | Harris et al. | |
| D83,704 | S | | 3/1931 | Stark | |
| 1,846,635 | A | * | 2/1932 | Finley | 83/56 |
| 1,894,614 | A | | 1/1933 | Wettlaufer | |
| 1,898,990 | A | * | 2/1933 | Harshberger | 52/525 |
| 1,975,487 | A | | 10/1934 | Topping | |
| 1,980,053 | A | * | 11/1934 | Harshberger | 52/547 |
| 1,993,134 | A | * | 3/1935 | Ford | 52/559 |
| 2,013,391 | A | * | 9/1935 | Searls | 52/523 |
| 2,027,029 | A | * | 1/1936 | Eckert | 52/526 |
| RE19,903 | E | * | 3/1936 | Harshberger | 52/526 |
| 2,064,473 | A | * | 12/1936 | Holdsworth | 52/555 |
| 2,087,595 | A | * | 7/1937 | Goslin | 52/555 |
| 2,106,396 | A | | 2/1938 | Smith | |
| 2,139,820 | A | * | 12/1938 | Graham | 52/557 |
| 2,161,440 | A | * | 6/1939 | Venrick | 52/555 |
| 2,162,886 | A | * | 6/1939 | Hamlin | 52/546 |
| 2,199,760 | A | | 5/1940 | Schuetz | |
| 2,205,679 | A | * | 6/1940 | Ames, Jr. | 52/554 |
| 2,272,032 | A | * | 2/1942 | Brown | 52/555 |
| 2,316,093 | A | * | 4/1943 | MacNutt | 52/409 |
| 2,687,701 | A | | 8/1954 | Abraham | |
| 3,407,556 | A | | 10/1968 | Leibrook | |
| 3,919,823 | A | | 11/1975 | Bradley | |
| 4,274,243 | A | | 6/1981 | Corbin et al. | |
| 4,333,279 | A | | 6/1982 | Corbin et al. | |
| 4,434,589 | A | | 3/1984 | Freiborg | |
| 4,499,702 | A | | 2/1985 | Turner | |
| 4,527,374 | A | | 7/1985 | Corbin | |
| D317,506 | S | | 6/1991 | Jenkins et al. | |
| 5,375,387 | A | * | 12/1994 | Davenport | 52/557 |
| 5,421,134 | A | | 6/1995 | Hannah et al. | |
| D366,124 | S | | 1/1996 | Hannah et al. | |
| 5,853,858 | A | * | 12/1998 | Bondoc | 428/195.1 |
| 5,939,169 | A | | 8/1999 | Bondoc et al. | |
| 6,058,670 | A | | 5/2000 | Sieling et al. | |
| D484,992 | S | | 1/2004 | Rodrigues | |
| 6,679,308 | B2 | | 1/2004 | Becker et al. | |
| 6,920,730 | B2 | | 7/2005 | Becker et al. | |
| 6,990,779 | B2 | | 1/2006 | Kiik et al. | |
| 7,510,622 | B2 | | 3/2009 | Kalkanoglu et al. | |
| 7,607,275 | B2 | | 10/2009 | Elliot et al. | |
| 9,057,194 | B2 | | 6/2015 | Jenkins et al. | |
| 2003/0172611 | A1 | | 9/2003 | Coco et al. | |
| 2004/0182032 | A1 | | 9/2004 | Koschitzky | |
| 2004/0206012 | A1 | * | 10/2004 | Pressutti et al. | 52/57 |
| 2007/0068108 | A1 | * | 3/2007 | Kiik et al. | 52/518 |
| 2011/0185668 | A1 | | 8/2011 | Kiik et al. | |
| 2013/0160389 | A1 | | 6/2013 | Leitch | |

* cited by examiner

ROOFING SHINGLE SYSTEM AND SHINGLES FOR USE THEREIN

FIELD OF THE INVENTION

This invention relates to an improved roofing system and roofing shingles that may be utilized in the roofing system. In particular, the invention relates to roofing shingles featuring unique dimensions and a roofing system that utilizes the shingles.

BACKGROUND OF THE INVENTION

Roofing products are often divided into three broad groups: shingles, roll roofing, and underlayment. Shingles and roll roofing typically function as outer roof coverings designed to withstand exposure to weather and the elements. Shingles and roll roofing generally contain the same basic components which provide protection and long term wear associated with asphalt roofing products. These components include a base material made from an organic felt or fiberglass mat which serves as a matrix to support the other components and gives the product the required strength to withstand manufacturing, handling, installation and service in the intended environment. An asphalt coating formulated for the particular service application is often applied to the base material to provide the desired long-term ability to resist weathering and to provide stability under temperature extremes. An outer layer of mineral granules is also commonly applied to the asphalt coating to form a surface exposed to the weather which shields the asphalt coating from the sun's rays, adds color to the final product and provides fire resistance.

Typically, shingles are installed on a roof deck such that the shingles are in a row from left to right and the lateral edges of the shingles in the row are contiguous with each other so as to abut each other, i.e. their lateral edges are adjacent to one another. Each row represents a course and the shingles are applied in overlapping courses on the roof deck, wherein the buttlap portion of a subsequent course is placed on the headlap portion of a previous course. The headlap portion of a conventional shingle is at least as wide as the buttlap portion of the shingle so that when the shingles are installed on a roof deck in overlapping courses, the entire buttlap portion of a subsequent course has headlap beneath it. This manner of installation prevents leakage to the roof deck where the lateral edges of the shingles abut each other.

In a typical roofing system, contiguous shingles in a row abut each other at their lateral edges. Thus, when the shingles are exposed to wet weather, it is possible that leakage can occur at the region where the shingles abut. To prevent that, overlapping subsequent rows of shingles are installed in an offset pattern and each shingle's headlap portion is at least as wide as the buttlap portion. Thus, when the shingles are applied to the roof in a plurality of courses and the buttlap portion of a second course of shingles is laid over the headlap portion of a first row of shingles there is always headlap present underneath the regions where the contiguous shingles in a row abut. Any water penetrating the places where lateral edges of shingles abut contacts the underlying headlap rather than the roof deck.

Asphalt shingles are among the most commonly used roofing materials. Asphalt shingles, such as those disclosed in U.S. Pat. No. 6,990,779, have been used extensively in residential housing as roof covering due to their aesthetics, ease of installation, water shedding function, and excellent field performance over a long period of time. U.S. Pat. No. 6,990,779 discloses a laminated roofing shingle system including a reduced-width headlap portion and an interply material that is installed under the buttlap portion in order to compensate for the reduced-width headlap portion and provide protection to the roof deck.

In some cases, prior art shingles may rely on redundant overlapping to ensure adequate water shedding performance, particularly in high wind or wind-driven rain conditions. For example, a typical prior art shingle know as a "3-tab shingle" would require approximately 240 $ft^2$ of sheet material to cover a 100 $ft^2$ of roof area (also known as a "square"). Other types of shingles also require significantly high amounts of overlapping materials to achieve adequate performance for resistance to water infiltration.

Single-layer strip shingles present a low cost roofing option, but presently available strip shingles are still more expensive than some consumers would like for homes, sheds, or other low cost buildings.

As energy costs rise, the cost of petroleum-based materials, such as asphalt, and transportation expenses often rise as well. The amount of material employed in a shingle can contribute to costs of the shingle and the overall weight of the shingle, which also affects transportation costs. Certain design requirements, such as a two inch or 2¼ inch material overlap from any point of water entry, constrain the possible dimensions for a shingle. Decreasing the amount of asphalt, substrate, and other materials required to make a shingle while maintaining the equivalent performance and coverage area can reduce both material costs and transportation expenses to deliver such shingles. Material costs (and transportation expenses) can be further reduced by maximizing the exposure (or coverage) of each individual shingle by requiring fewer shingles to cover a roof deck.

Various shingles have been developed that employ a shiplap or side-lap feature such that when applied to a roof deck at least part of the lateral edges of neighboring shingles overlap. U.S. Pat. No. 2,106,396 discloses single layer asphalt coated shingles having serrated edges having edge and corner elements. When the shingles are applied to a roof deck, their lateral edges overlap. The edge and corner elements of the shingles may be utilized as guides for laying the elements of each shingle in proper relation to each other in each course and also for properly relating the elements in one course to those in a subjacent course.

U.S. Pat. No. 2,272,032 describes single layer asphalt roofing shingles with varying cross-sectional thickness to be arranged in offset overlapping courses, wherein the side edge portions of adjacent shingles in the same course overlap. The shingle has longitudinal zigzag edge contours, which shadow each other on either side of the shingle such that the width of the shingle is constant across the length of the shingle. When the courses are installed, the thicker portions of a subsequent shingle "nest" in the thinner portions of the previously installed shingle to provide the protection qualities of more heavily coated roofing material.

U.S. Pat. No. 2,687,701 discloses single layer tabbed asbestos cement roofing shingles comprising projections on the front and rear edges. When the shingles are applied to a roof deck, their lateral edges overlap. The shingles comprise projections which extend above and over the buttlap portion of a previous course when a subsequent course is installed. The overlapping and projections are intended to create a more dimensional appearance.

U.S. Pat. No. 3,919,823 discloses single layer asphalt roofing shingles. The shingles comprise various projections on the front edge. The shingles are installed such that their lateral edges overlap to create what is described as a "shadow effect" which will vary depending on the time of day.

U.S. Pat. No. 4,274,243 discloses a laminated asphalt roofing shingle to be arranged in overlapping courses to optically simulate tiles. The shingle has a buttlap portion with curved tile-like features and the left-most tile-like feature includes an overlap portion that extends over the adjoining edge of a neighboring shingle to hide the adjoining edge between the shingles.

U.S. Pat. Nos. 4,333,279 and 4,527,374 disclose strip or tabbed single layer asphalt shingles. The shingles comprise various edges at least one of which is an alignment edge. The shingles are overlapped using the alignment edge in order to achieve a desired pattern when the shingles are installed on a roof deck.

U.S. Pat. Appl. Publ. No. 2004/0182032 discloses a multi-layer laminate shingle with a reduced-width headlap portion. The shingle has a base layer and at least a second layer above the base layer. At one end of the shingle the base layer projects beyond the second layer while at the other end the second layer projects beyond the base layer. When the shingles are laid in a course along the roof, the projecting end of the second layer overlaps the projecting end of the base layer of the previously installed shingle, forming a shiplap joint over all or substantially all of the width of the shingle.

U.S. Pat. Appl. Publ. No. 2011/0185668 discloses a laminated roofing shingle system including a reduced-width headlap portion, wherein the roofing system comprises a plurality of courses, and wherein a trailing edge of a subsequently installed shingle in a course overlaps the leading edge of an adjacent previously installed shingle in the same course.

In addition to certain of the shingles discussed above, various shingles have employed non-straight edge contours. U.S. Pat. No. 1,732,403 discloses a tabbed strip shingle and method of forming the shingle. The shingles are cut from a sheet of roofing material, wherein the front edge profile of the shingles are cut with a zigzag pattern to form complementary shingles. The tabs of the shingles are separated by parallel slots and have a generally triangular front edge with a small horizontal tip portion. When installed, the small horizontal tip portion of the tabs of shingles in a subsequently installed course align with the ends of the slots of shingles in a previously installed course. The shingles require approximately 225 $ft^2$ of sheet material to cover a 100 $ft^2$ of roof area.

U.S. Pat. No. 1,846,635 discloses a method of cutting so-called hexagonal strip shingles without waste from a parent sheet of prepared roofing. Each shingle has an exposed edge that defines projecting tongues having three sides of a hexagonal shape separated by recesses. When installed the projecting tongues match with the recesses of previously installed shingles, i.e., the projecting tongues have an end breadth equal to the breadth of the recesses in the buttlap. The shingles may also have a headlap with projections and recesses, wherein the end breadths of the headlap projections are equal to the headlap recesses and different from the tongue end breadths and buttlap recesses. U.S. Pat. No. 1,846,635 further discloses a formula for calculating the average exposed width of the shingle and that the shingle has a maximum width ("extreme width") that is twice the average exposed width plus the desired overlap from a successively installed shingle.

U.S. Pat. Appl. Publ. No. 2003/0172611 discloses shingles having a headlap region and a visual feature region, wherein the visual feature region includes teeth and cutout spaces that are identical in shape and size, with respect to each other. When installed, an alternating pattern is achieved along a vertical line extending up the shingled roof between teeth and cutout spaces of the visual feature regions of overlapped, vertically adjacent shingles.

U.S. Pat. Appl. Publ. No. 2013/0160389 discloses shingles having a headlap portion with a non-straight longitudinal edge and a buttlap portion with a non-straight longitudinal edge, wherein the non-straight longitudinal edges do not shadow each other laterally across the shingle. U.S. Pat. Appl. Publ. No. 2013/0160389 further discloses a roofing system wherein at least a portion of the headlap portion of a shingle in a subsequently installed course overlaps at least a portion of the headlap portion of a shingle in a previously installed course and a maximum headlap overlap dimension is beneath the subsequently installed shingle laterally proximate the openings in the buttlap portion of the subsequently installed shingle. U.S. Pat. Appl. Publ. No. 2013/0160389 further discloses a method of making the shingles wherein the shingles are cut from a sheet of roofing material longitudinally along non-straight lines.

Each of the above-referenced patents and patent applications is incorporated herein by reference in their entirety for all purposes within this application.

SUMMARY OF THE INVENTION

In accordance with the present invention, a roofing system is provided having a multiplicity of courses of roofing shingles having a reduced-width headlap portion including headlap projections and headlap recesses, and a buttlap portion including buttlap projections and buttlap recesses, wherein a lateral trailing edge of a shingle in a first course overlaps (side-laps) an adjacent previously installed shingle in the first course to form a side-lap region, and wherein the headlap projection nearest the lateral leading edge has a breadth greater than at least one headlap projection in the same shingle to provide additional shingle material underneath a shingle in a subsequent course that partially overlaps the side-lap region between adjacent shingles in the first course.

When arranged in a roofing system comprising overlapping courses of shingles, one embodiment of this invention provides (a) a generally uniform overlap region between a subsequent course of shingles and an immediately preceding course of shingles, wherein the transverse dimension of the generally uniform overlap region remains generally consistent across the length of the overlapped shingles, e.g., differing by 10% or less, and (b) an expanded overlap region, wherein a portion of a shingle in the immediately preceding course of shingles provides additional material underneath an area proximate to the trailing edge of a shingle in the subsequent course. The generally uniform overlap region allows for a reduction in the amount of material necessary to provide sufficient overlap between courses of necessary for sufficient weather performance, while the expanded overlap region provides additional material overlap at an area that may be susceptible to water penetration (e.g., underneath the trailing edge of a shingle proximate to a shiplap joint).

One embodiment of this invention pertains to a new asphalt containing roofing shingle that improves upon the utilization of materials required to make the shingle compared to prior art strip shingles, while improving upon the aesthetic appearance of prior art strip shingles.

The unique dimensions of the shingles of the invention provide appropriate water shedding performance and minimize the amount of material required to cover a roof deck. The unique dimensions of the shingle also provide a pleasing aesthetic appearance that may be further enhanced by surfacing the shingles with two or more contrasting shades of granules, which may create the appearance of increased shingle thickness.

In a preferred embodiment, a roofing shingle is provided comprising a headlap portion, a buttlap portion, a lateral leading edge, and a lateral trailing edge, wherein the buttlap portion includes a plurality of buttlap projections extending away from the shingle defining a maximum buttlap width and a plurality of recessed horizontal buttlap portions, wherein each buttlap projection includes a horizontal edge defining a projected horizontal buttlap portion, wherein the projected horizontal buttlap portions have a primary horizontal breadth that is preferably about equal for each projected horizontal buttlap portion, and is preferably about equal to the breadth of at least one recessed horizontal buttlap portion, wherein the headlap portion includes a plurality of headlap projections extending away from the shingle defining a maximum headlap width and a plurality of recessed horizontal headlap portions, wherein each headlap projection includes a horizontal edge defining a projected horizontal headlap portion, wherein a first projected horizontal headlap portion nearest to the lateral leading edge has a breadth that is greater than the primary horizontal breadth, and wherein at least another projected horizontal headlap portion and at least one recessed horizontal headlap portion have a breadth that is preferably about equal to the primary horizontal breadth, and wherein the maximum headlap width is less than the maximum buttlap width.

In a preferred embodiment, the headlap portion is surfaced with a first shade of granules and said buttlap portion is surfaced with a second shade of granules. In a further preferred embodiment, the buttlap portion is further surfaced with a third shade of granules on the buttlap projections.

In a preferred embodiment, the maximum headlap width is approximately 60% of the maximum buttlap width.

In a preferred embodiment, the buttlap projections have a height of about 2 inches. In a further preferred embodiment, the headlap projections have a height of about 1¾ inches.

In a preferred embodiment, the breadth of the first projected horizontal headlap portion nearest to the lateral leading edge is about 125% the primary horizontal breadth.

In a preferred embodiment, the primary horizontal breadth is about 6 inches.

In a preferred embodiment, at least one buttlap projection mirrors one of the headlap projections laterally across the shingle.

In a preferred embodiment, the shingles are single-layer.

In a preferred embodiment, a roofing system is provided comprising shingles of the invention, wherein the roofing system comprises a plurality of courses of the shingles, and wherein the lateral trailing edge of a subsequently installed shingle in a first course of shingles overlaps the lateral leading edge of an adjacent previously installed shingle in the first course to provide a side-lap region, and wherein the side-lap region forms a part of a partially side-lapped recessed horizontal buttlap portion having a breadth about equal to the primary horizontal breadth, and wherein the buttlap projections of a shingle in a subsequent course of shingles provides a uniform overlap dimension over the recessed horizontal headlap portions of a shingle in the first course.

In a particularly preferred embodiment, the buttlap projection nearest to the trailing edge of the shingle in the subsequent course of shingles overlaps the side-lap region between adjacent shingles in the first course.

In a particularly preferred embodiment, the side-lap region has a breadth of about 3 inches.

In another embodiment, the roofing system consists essentially of the shingles of the invention.

In another preferred embodiment, a roofing system is provided comprising single-layer shingles having a length, a headlap portion, a buttlap portion, a lateral leading edge, and a lateral trailing edge, wherein the buttlap portion includes a plurality of buttlap projections extending away from the shingle defining a maximum buttlap width, wherein the buttlap projections have a breadth that is about equal for each buttlap projection defining a primary projection breadth, wherein the headlap portion includes a plurality of headlap projections extending away from the shingle defining a maximum headlap width, wherein a first headlap projection nearest to the lateral leading edge has an increased projection breadth that is greater than the primary projection breadth and at least another headlap projection has a breadth that is about equal to the primary projection breadth, wherein the maximum headlap width is less than the maximum buttlap width, wherein the roofing system comprises a plurality of courses of the shingles, and wherein the lateral trailing edge of a subsequently installed shingle in a first course of shingles overlaps the lateral leading edge of an adjacent previously installed shingle in the first course to provide a side-lap region, and wherein a shingle in a subsequent course of shingles provides:

(a) a generally uniform overlap region over the headlap portions of a first adjacent shingle and a second adjacent shingle in the first course, wherein the generally uniform overlap region has a transverse dimension that varies by less than 10% across the length of shingle in the subsequent course; and (b) an expanded overlap region over the headlap portion of the second adjacent shingle, wherein the expanded overlap region is due to the increased projection breadth of the first headlap projection nearest to the lateral leading edge of the second adjacent shingle.

In a preferred embodiment, the buttlap projections and the headlap projections have a trapezoidal shape. In a further preferred embodiment, the buttlap projections have a minimum breadth that extends away from the shingle, and wherein the headlap projections have a minimum breadth that extends away from the shingle.

In another preferred embodiment, a roofing shingle is provided comprising a headlap portion, a buttlap portion, a lateral leading edge, and a lateral trailing edge, wherein the buttlap portion includes a plurality of buttlap projections extending away from the shingle defining a maximum buttlap width and a plurality of recessed horizontal buttlap portions, wherein each buttlap projection includes a horizontal edge defining a projected horizontal buttlap portion, wherein the projected horizontal buttlap portions each have a horizontal buttlap breadth that differs from each other by between 0% and 20%, and differs from the breadth of at least one recessed horizontal buttlap portion by between 0% and 20%, and wherein at least one projected horizontal buttlap portion has a maximum horizontal buttlap breadth, wherein the headlap portion includes a plurality of headlap projections extending away from the shingle defining a maximum headlap width and a plurality of recessed horizontal headlap portions, wherein each headlap projection includes a horizontal edge defining a projected horizontal headlap portion, wherein a first projected horizontal headlap portion nearest to the lateral leading edge has a breadth that is greater than the maximum horizontal buttlap breadth, and wherein at least another projected horizontal headlap portion and at least one recessed horizontal headlap portion have a breadth that differs from the horizontal buttlap breadth of each of the projected horizontal buttlap portions by between 0% and 20%, and wherein the maximum headlap width is less than the maximum buttlap width.

The roofing system and shingles of the invention are an improvement of roofing systems and shingles known in the art, wherein the improvements provide roofing shingles having a reduced-width headlap and unique shape and/or dimensions, which provide increased coverage for each shingle of the invention when installed on a roof deck compared to prior art shingles. The roofing system and shingles of the invention allow for increased utilization of materials necessary to make the shingles of the invention compared to the amount of material necessary to make traditional, prior art shingles, i.e., the shingles of the invention allow for the use of less material than prior art shingles.

A further improvement is providing roofing shingles having large exposure areas and improved aesthetics that can be manufactured at current strip shingle plants with little mechanical changes to the plants.

DETAILED DESCRIPTION OF THE FIGURES

For a more complete understanding of the present invention, and the advantages thereof, reference is now made to the following descriptions taken in conjunction with the accompanying figures, but which are not to be construed as limiting to the scope of the present invention as defined by the appended claims, in which:

DETAILED DESCRIPTION

Figure 1A:
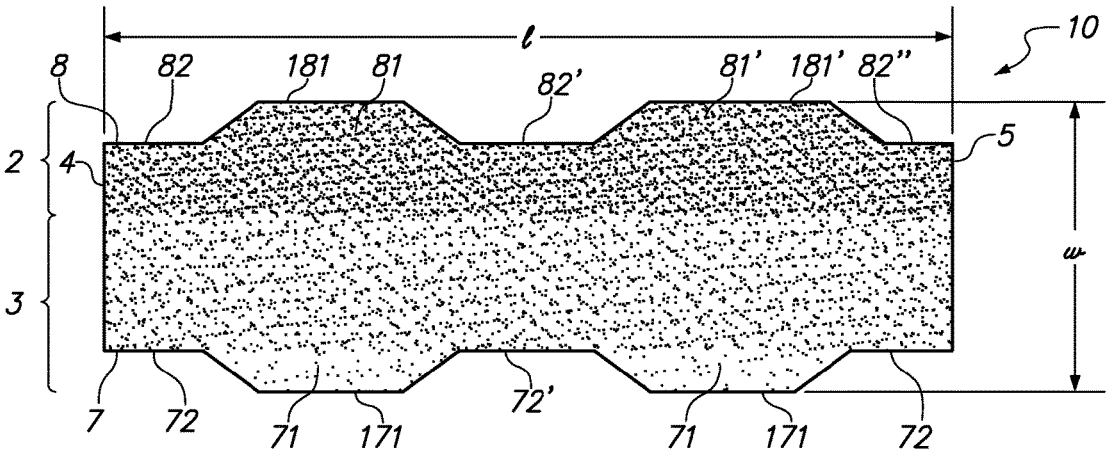
FIG. 1A shows a top plan view of an exemplary embodiment of a roofing shingle of the present invention.

The preferred embodiments of the present invention and its advantages are best understood by referring to non-limiting FIGS. 1 through 10, like numerals being used for like and corresponding parts of the various drawings. Reference to the figures herein is not intended to limit the scope of the invention, but allows further description of the invention through exemplary embodiments.

The first embodiment of the present invention, which relates to a roofing system comprising single-layer shingles having a headlap portion including headlap projections and headlap recesses, and a buttlap portion including buttlap projections and buttlap recesses that, when installed in a side-lap (or shiplap) fashion, enables an increase in shingle exposure, will now be described in greater detail by referring to the drawings that accompany the present application.

Figure 7:
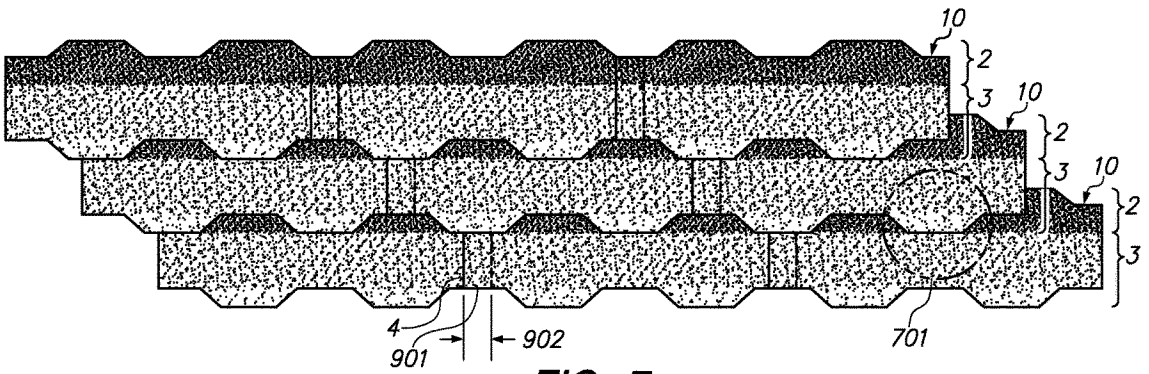
FIG. 7 shows a top plan view of an exemplary embodiment of a roofing system of the present invention incorporating the exemplary embodiment of the roofing shingle of the present invention depicted in FIG. 1A.
Figure 8:
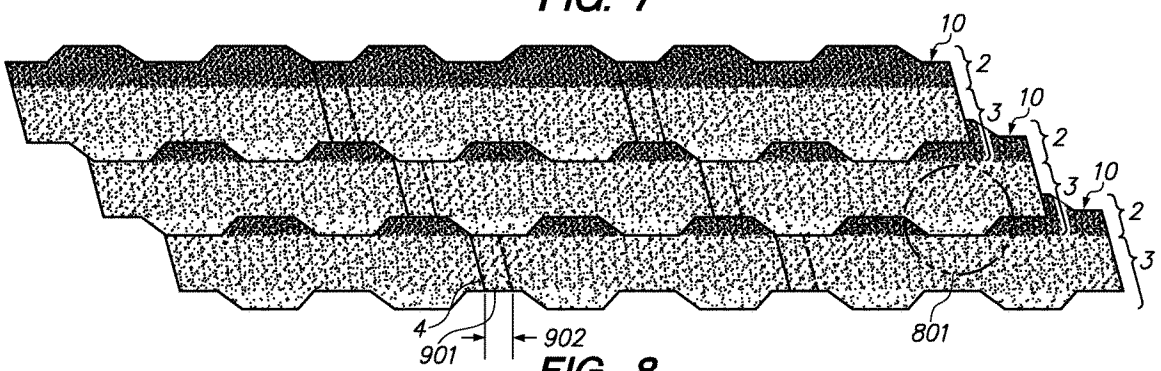
FIG. 8 shows a perspective view of the exemplary embodiment of a roofing system of the present invention depicted in FIG. 7.
Figure 9:
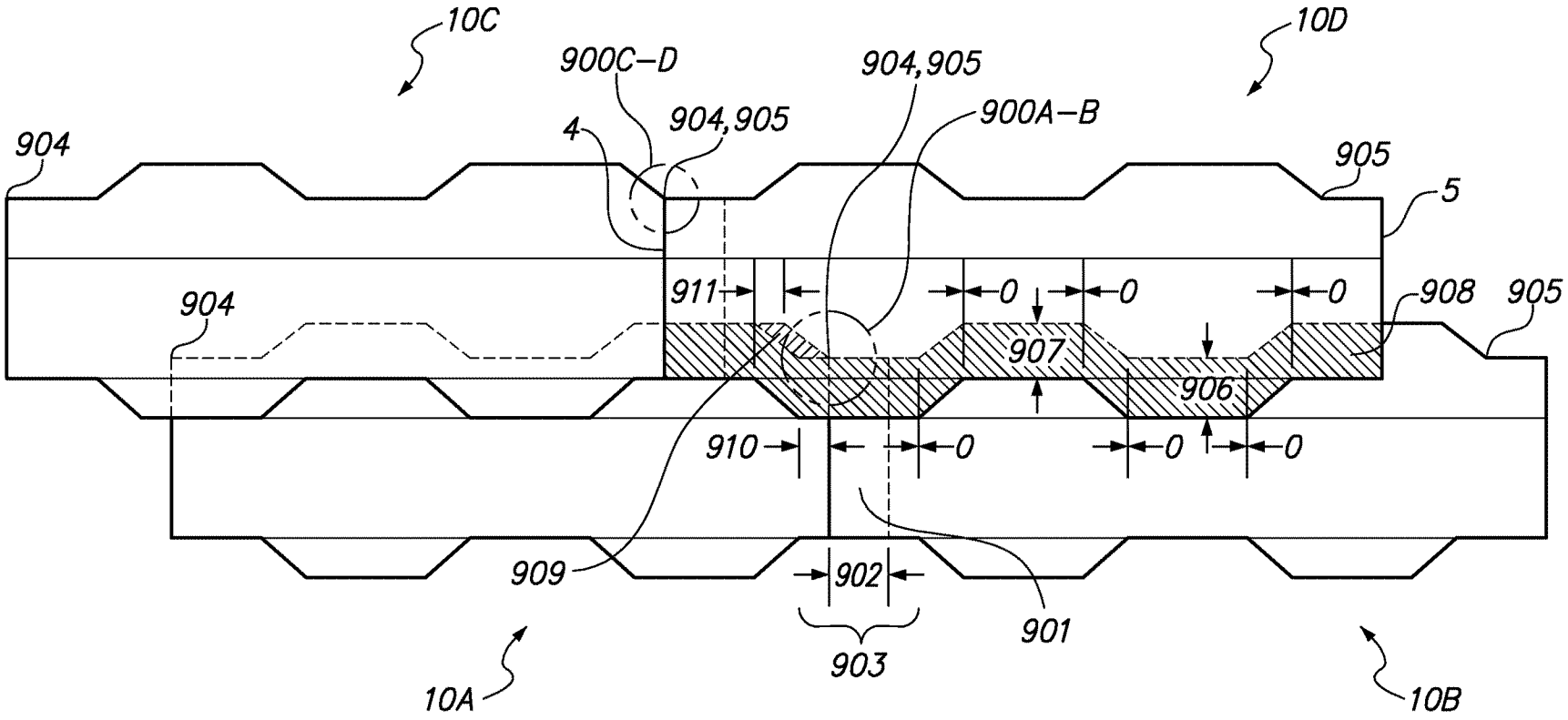
FIG. 9 shows a top plan view of an exemplary embodiment of a roofing system of the present invention incorporating the exemplary embodiment of the roofing shingle of the present invention depicted in FIG. 1A, illustrating overlapped portions of the shingles in broken lines.
Figure 10:
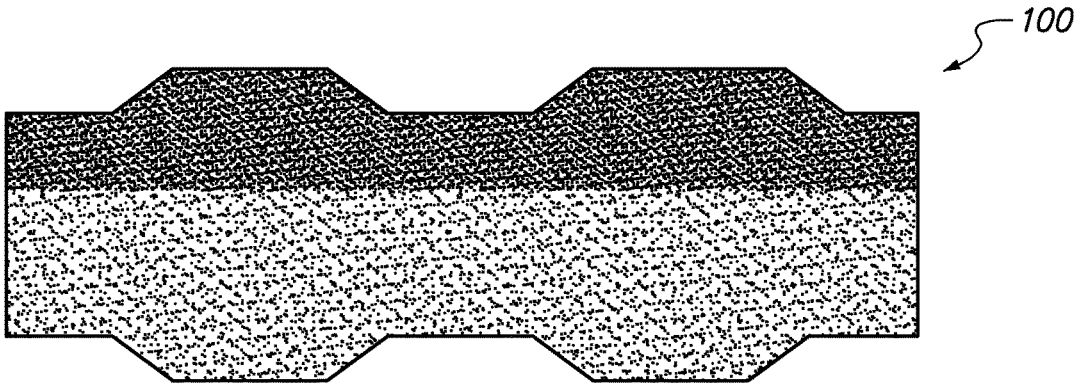
FIG. 10 shows a top plan view of a second exemplary embodiment of the roofing shingle of the present invention.

A shingle 10 incorporating one embodiment of the present invention is shown in FIGS. 1-9. FIG. 1A illustrates a top plan view of shingle 10. Shingle 10 has a width (w) and a length (l). Shingle 10 comprises a headlap portion 2, a buttlap portion 3, a non-straight longitudinal front edge 7, a non-straight longitudinal rear edge 8, a lateral leading edge 5, and a lateral trailing edge 4. The non-straight longitudinal front edge 7 includes buttlap projections 71 and recessed horizontal buttlap portions 72, 72'. The non-straight longitudinal rear edge 8 includes headlap projections 81 and recessed horizontal headlap portions 82, 82', 82". When installed on a roof deck, as illustrated in FIGS. 7 and 8, a portion of the headlap portion 2 of a previously installed shingle 10 is covered by a portion of the buttlap portion 3 of a subsequently installed shingle 10 and, as illustrated in FIG. 9, the trailing edge 4 of subsequently installed shingle 10B overlaps (i.e., side-laps) a portion of a previously installed shingle 10A.

Figure 1B:
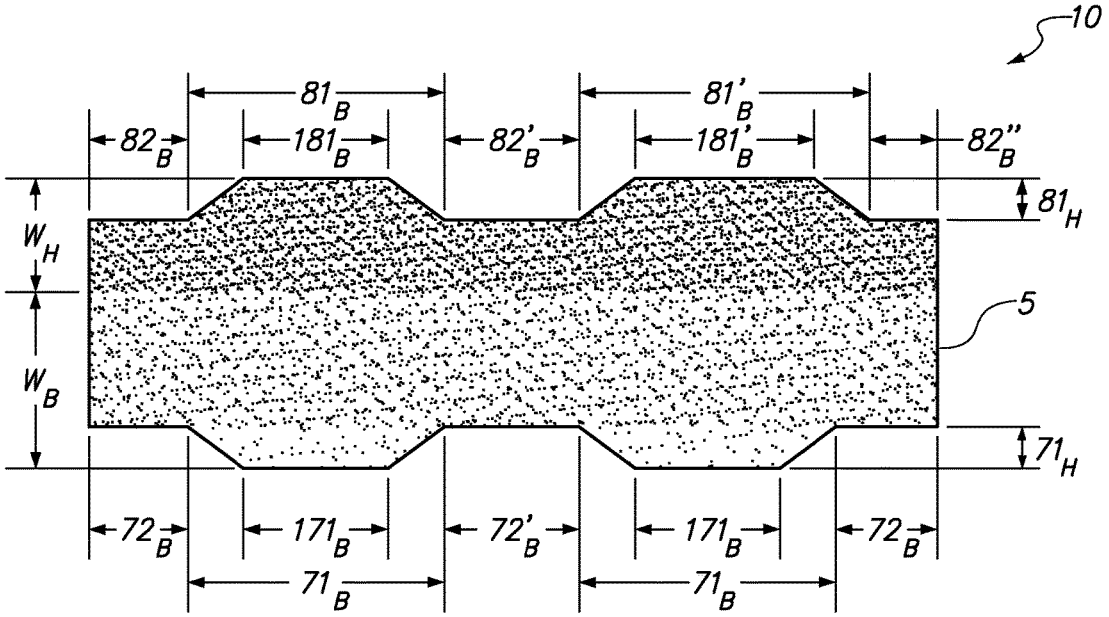
FIG. 1B shows a top plan view of the exemplary embodiment of the roofing shingle of the present invention depicted in FIG. 1A, further illustrating additional dimensions.
Figure 2:
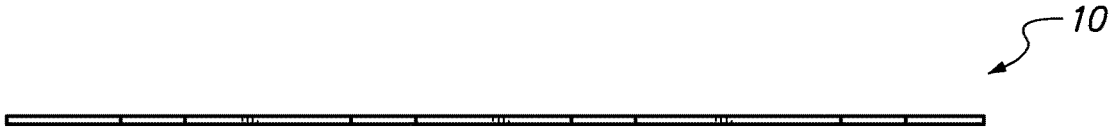
FIG. 2 shows a front elevation view of the exemplary embodiment of the roofing shingle of the present invention depicted in FIG. 1A.
Figure 3:
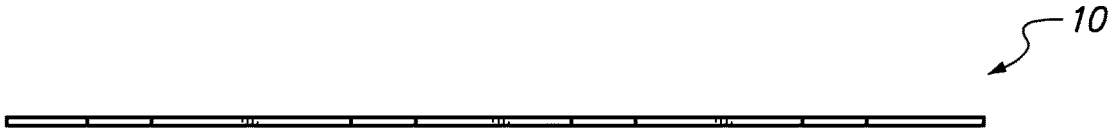
FIG. 3 shows a rear elevation view of the exemplary embodiment of the roofing shingle of the present invention depicted in FIG. 1A.
Figure 4:
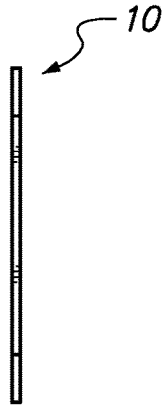
FIG. 4 shows a right side view of the exemplary embodiment of the roofing shingle of the present invention depicted in FIG. 1A.
Figure 5:
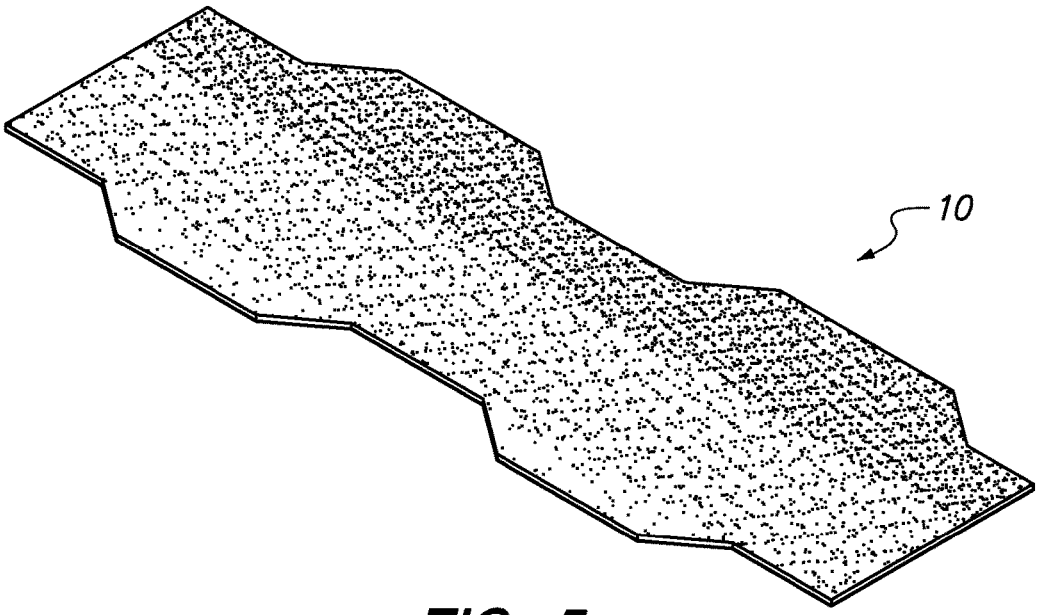
FIG. 5 shows a perspective view of the exemplary embodiment of the roofing shingle of the present invention depicted in FIG. 1A.
Figure 6:
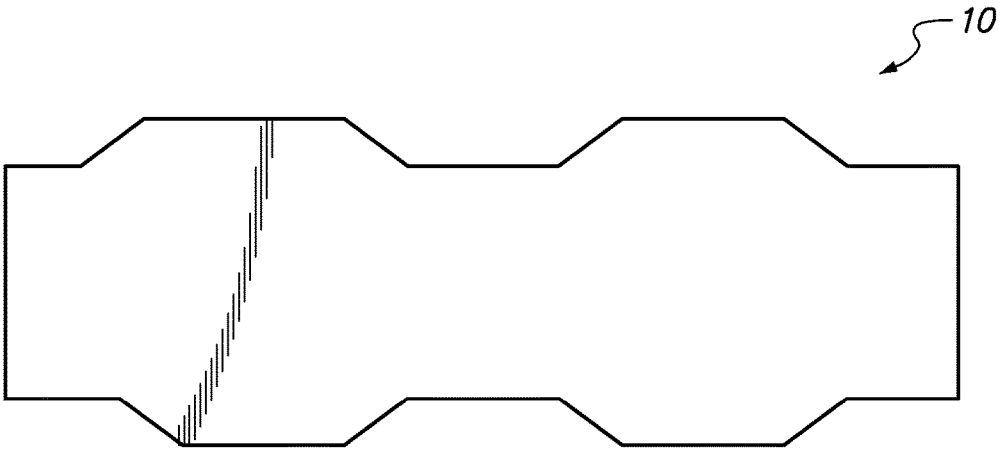
FIG. 6 shows a bottom plan view of the exemplary embodiment of the roofing shingle of the present invention depicted in FIG. 1A.

Referring to FIGS. 1A and 1B, buttlap projections 71 extend away from the shingle to define a maximum buttlap width $W_B$. Each buttlap projection 71 has a primary projection breadth $\mathbf{71}_B$ that is about equal for each buttlap projection 71. The buttlap projections 71 have a buttlap projection height $\mathbf{71}_H$.

Preferably, the maximum buttlap width may be between 5 and 10¾ inches, more preferably between 7½ and 8½ inches, and even more preferably about 8 inches. Preferably, the primary projection breadth may be between 4¾ and 11¾ inches, more preferably between 9¼ and 11¾ inches, and even more preferably about 10½ inches. Preferably, the buttlap projection height may be between ½ and 3½ inches, more preferably between 1½ and 2 inches, and even more preferably about 2 inches.

Headlap projections 81 and 81' extend away from the shingle to define a maximum headlap width $W_H$. A first headlap projection 81' nearest to the lateral leading edge 5, i.e., a leading headlap projection, has an increased projection breadth $\mathbf{81'}_B$ that is greater than the primary projection breadth $\mathbf{71}_B$. At least another headlap projection 81 has a breadth $\mathbf{81}_B$ that is about equal to the primary projection breadth $\mathbf{71}_B$. The headlap projections have a height $\mathbf{81}_H$.

Preferably, the maximum headlap width may be between 2 and 5 inches, more preferably between 3½ and 5 inches, and even more preferably about 4¾ inches. Preferably, the increased projection breadth may be between 6¼ and 13¼ inches, more preferably between 9¼ and 13¼ inches, and even more preferably about 12 inches, but is greater than the primary projection breadth. Preferably, the breadth of the at least another headlap projection may be between 4¾ and 11¾ inches, more preferably between 9¼ and 11¾ inches, and even more preferably about 10½ inches. In a particularly preferred embodiment, the breadth of the at least another headlap projection (see, e.g., FIG. 1B, feature $\mathbf{81}_B$) is about equal to the primary projection breadth. Preferably, the headlap projection height may be between ½ and 2 inches, more preferably between 1½ and 2 inches, and more preferably about 1¾ inches.

Each buttlap projection 71 includes a horizontal edge defining a projected horizontal buttlap portion 171 having a primary horizontal breadth $\mathbf{171}_B$ that is about equal for each projected horizontal buttlap portion 171. The recessed horizontal buttlap portions 72 and 72' have a first recessed horizontal buttlap breadth $\mathbf{72}_B$ and a second recessed horizontal buttlap breadth $\mathbf{72'}_B$, respectively. In this embodiment, the second recessed horizontal buttlap breadth $\mathbf{72'}_B$ is about equal to the primary horizontal breadth $\mathbf{171}_B$.

Preferably, the primary horizontal breadth may be between 3 and 8 inches, more preferably between 5¾ and 6¼ inches, and even more preferably about 6 inches.

Preferably, the first recessed horizontal buttlap breadth may be between 3½ and 7 inches, more preferably between 4 and 6 inches, and even more preferably about 4½ inches or about 5⅝ inches. Preferably, the second recessed horizontal buttlap breadth may be between 3 and 6¼ inches, more preferably between 5¾ and 6¼ inches, and even more preferably about 6 inches. In a particularly preferred embodiment, the second recessed horizontal buttlap breadth is about equal to the primary horizontal breadth.

For one embodiment depicted in FIGS. 1-9, and referencing FIGS. 1A and 1B, each headlap projection 81, 81' includes a horizontal edge defining a projected horizontal headlap portion 181, 181'. A first projected horizontal headlap portion 181' nearest to the lateral leading edge 5, i.e., a leading projected horizontal headlap portion, has a breadth $\mathbf{181'}_B$ that is greater than the primary horizontal breadth $\mathbf{171}_B$. At least another projected horizontal headlap portion 181, i.e., a non-leading projected horizontal headlap portion, has a breadth $\mathbf{181}_B$ that is about equal to the primary horizontal breadth $\mathbf{171}_B$. The recessed horizontal headlap portions, e.g., a first, second, and third recessed horizontal headlap portion, 82, 82', and 82", respectively, have a first recessed horizontal headlap breadth $\mathbf{82}_B$, a second recessed horizontal headlap breadth $\mathbf{82'}_B$, and a third recessed horizontal headlap breadth $\mathbf{82''}_B$, respectively. In this embodiment, the second recessed horizontal headlap breadth $\mathbf{82'}_B$ is about equal to the primary horizontal breadth $\mathbf{171}_B$.

Preferably, the breadth of the first projected horizontal headlap portion nearest to the lateral leading edge may be between 4½ and 7¾ inches, more preferably between 7¼ and 7¾ inches, and even more preferably about 7½ inches, but is greater than the primary horizontal breadth. Preferably, the breadth of the first projected horizontal headlap portion may be greater than the primary horizontal breadth by between 100% and 150%, more preferably between 120% and 130% and more preferably about 125%. Preferably, the breadth of the at least another projected horizontal headlap portion may be between 3 and 8 inches, more preferably between 5¾ and 6¼ inches, and even more preferably about 6 inches. In a particularly preferred embodiment, the breadth of the at least another projected horizontal headlap portion is about equal to the primary horizontal breadth.

Preferably, the first recessed horizontal headlap breadth may be between 3½ and 7 inches, more preferably between 4 and 6 inches, and even more preferably about 4½ inches or about 5⅝ inches. Preferably, the second recessed horizontal headlap breadth may be between 3 and 6¼ inches, more preferably between 5¾ and 6¼ inches, and even more preferably about 6 inches. In a particularly preferred embodiment, the second recessed horizontal headlap breadth is about equal to the primary horizontal breadth. Preferably, the third recessed horizontal headlap breadth may be between 2 and 5½ inches, more preferably between 3 and 5 inches, and even more preferably about 3 inches.

In another embodiment, the breadth of the projected horizontal buttlap portions may differ from each other by between 0% and 20%, and preferably less than 5%, and may differ from the breadth of at least one recessed horizontal buttlap portion by between 0% and 20%, and preferably less than 5%. In yet another embodiment, the breadth of the projected horizontal buttlap portions may differ from the breadth of at least one projected horizontal headlap portion and the breadth of at least one recessed horizontal headlap portion by between 0% and 20%, and preferably less than 5%.

Shingle 10 has a maximum buttlap width $W_B$. Shingle 10 also has a maximum headlap width $W_H$ that is less than the maximum buttlap width $W_B$, which defines a reduced-width headlap. Preferably, the maximum headlap width may be between 20% and 100% of the maximum buttlap width. In a preferred embodiment, the maximum headlap width is approximately 60% of the maximum buttlap width.

As depicted in FIGS. 1-9, shingle 10 of the invention may have a headlap portion 2 that is surfaced with a first shade of granules, a portion of a buttlap portion 3 that is surfaced with a second shade of granules, and buttlap projections 71 that are surfaced with a third shade of granules. However, the entire buttlap portion may be surfaced with the second shade of granules. See FIG. 10, shingle 100. Furthermore, it is contemplated that the headlap portion and buttlap portion may be surfaced with the same shade of granules. Further yet, it is contemplated that the buttlap portion may be surfaced with a blend of at least two different shades of granules, e.g., from light to dark or dark to light.

In a particularly preferred embodiment, the first shade of granules on the headlap portion is the darkest of the three shades of granules and the third shade of granules on the buttlap projections is the lightest of the three shades of granules. This arrangement of granule shading on the shingles provides a particularly striking appearance of increased shingle thickness when the shingles are installed on a roof deck in accordance with the present invention. See FIGS. 7 and 8.

Referring to FIGS. 1A and 1B, shingle 10 of the invention may have a buttlap projection 71 that mirrors a headlap projection 81 laterally across the shingle. It will be appreciated that the shape of the buttlap projection 71 is about the same as the reflected shape of the headlap projection 81. It is contemplated that the shapes of the buttlap projection 71 and the reflected headlap projection 81 may vary from each other. In a preferred embodiment, a buttlap projection may have a buttlap projection height of 2 inches and the reflected headlap projection may have a headlap projection height of 1¾ inches and approximately the same shape (e.g., trapezoidal) with minimum breadths (e.g., primary horizontal breadth $\mathbf{171}_B$ and breadth $\mathbf{181}_B$) that are about equal. The reflected shapes may vary due to the difference in heights between the buttlap projection and reflected headlap projection, but it will be appreciated that, as depicted in FIGS. 1A and 1B, the entire breadth $\mathbf{171}_B$ of the projected horizontal buttlap portion 171 preferably aligns with the entire breadth $\mathbf{181}_B$ of the reflected projected horizontal headlap portion 181.

In contrast to these reflected projections, and with continued reference to FIGS. 1A and 1B, the first headlap projection 81' nearest to the lateral leading edge 5 does not mirror a buttlap projection 71 laterally across the shingle, primarily because the first headlap projection 81' has a wider breadth $\mathbf{181'}_B$ than the primary horizontal breadth $\mathbf{171}_B$ of the buttlap projection 71 situated laterally across the shingle.

Referring to FIG. 9, shingles 10 of the invention are installed on a roof deck in a side-lap fashion, wherein the lateral trailing edge 4 of subsequently installed shingle 10B overlaps the lateral leading edge of adjacent previously installed shingle 10A in a first course to provide a side-lap region 901 having a side-lap breadth 902. The side-lap region 901 and the recessed horizontal buttlap portions 72 of the adjacent shingles 10A and 10B form a partially side-lapped recessed horizontal buttlap portion 903. Preferably, the side-lap breadth may be between 2 and 5½ inches, more preferably between 3 and 5 inches, and even more preferably about 3 inches or 5 inches. Preferably, the partially side-lapped recessed horizontal buttlap portion has a breadth that may be between 3 and 6¼ inches, more preferably between 5¾ and 6¼ inches, and even more preferably about 6 inches. In a particularly preferred embodiment, the breadth of the partially side-lapped recessed horizontal buttlap portion is about equal to the primary buttlap breadth.

With continued reference to FIG. 9, in a preferred embodiment, a rear corner 904 of the lateral trailing edge of subsequently installed shingle 10B may align with a convergence point 905 between the headlap projection 81' nearest to the leading lateral edge 5 and the recessed headlap portion 82" of previously installed shingle 10A. See FIG. 9, features 900A-B and 900C-D.

In the preferred embodiment depicted in FIG. 9, a shingle 10D is installed in a subsequent course such that a portion of the buttlap portion 3 of shingle 10D overlaps a portion of the headlap portions 2 of shingles 10A and 10B in the first course to provide a generally uniform overlap region 908 and an expanded overlap region 909.

Regarding the generally uniform overlap region 908, the buttlap portion 3 of shingle 10D provides a first substantially uniform overlap dimension 906 over the second recessed horizontal portion 82' (measured transversely across the generally uniform overlap region 908) and a second substantially uniform overlap dimension 907 over the projected horizontal headlap portion 181 of shingle 10B in the previous course (measured transversely across the generally uniform overlap region 908). Preferably, the first substantially uniform overlap dimension may be between 2 and 5, and more preferably about 3 inches. Preferably, the second substantially uniform overlap dimension may be between 2 and 5, and more preferably about 2¾ inches. Preferably, the generally uniform overlap region has a transverse dimension that varies by less than 10% across the length of the shingle in the subsequent course.

Regarding the expanded overlap region 909, the increased projection breadth $\mathbf{81'}_B$ (increased relative to the primary projection breadth $\mathbf{71}_B$) of the leading headlap projection 81' of shingle 10A allows leading headlap projection 81' of shingle 10A to provide additional material under the trailing side of shingle 10D in a subsequent course. In the embodiment depicted in FIG. 9, leading headlap projection 81' has a shape (e.g., trapezoidal) similar to a non-leading headlap projection 81 (which preferably mirrors buttlap projection 71), but differs from the non-leading headlap projection 81 in breadth, which results in leading headlap projection 81' providing a parallelogram-shaped area of additional material (i.e., expanded overlap region 909). In the exemplary embodiment depicted in FIG. 9, expanded overlap region 909 has front and rear horizontal dimensions 910 and 911, respectively. It will be appreciated that expanded overlap region 909 extends away from the generally uniform overlap region 908. It will further be appreciated that, in the embodiment depicted in FIG. 9, the generally uniform overlap region 908 has points of alignment between at least some of the corners of the buttlap projections 71 of shingle 10D and at least some of the ends of the recessed horizontal headlap portions 82, 82', 82" of shingle 10B, and between at least some of the ends of the recessed horizontal buttlap portions 72, 72' of shingle 10D and at least some of the corners of the headlap projections 81, 81'. See FIG. 9, features 0.

With continued reference to FIG. 9, the expanded overlap region 909 is preferably underneath the buttlap projection 71 nearest the trailing edge 4 of a shingle 10D installed in a subsequent course. This arrangement is preferable because expanded overlap region 909 provides additional material underneath shingle 10D proximate a possible water entry point (i.e., at or near the side-lap region). The generally uniform overlap region in accordance with the present invention is preferable because it allows for sufficient amounts of material overlap to provide water shedding performance, but minimizes excess material underneath shingles in subsequent courses.

As depicted in FIG. 9, and with reference to FIGS. 1A and 1B, shingles 10A and 10B (and shingles 10C and 10D) are installed in a left to right manner. This arrangement is preferable due to the location of the leading headlap projection 81' having an increased projection breadth $\mathbf{181'}_B$ (i.e., located on the right-side of the shingle 10). However, it will be appreciated that leading headlap projection having an increased projection breadth may be located on the left-side of the shingle and therefore the shingles of the invention may preferably be installed in a right to left manner.

It will be further appreciated that the projected headlap portion having an increased projection breadth may be nearest to the trailing edge of the shingle, as long as the subsequent course of shingles are arranged over a preceding course of shingles such that the increased breadth of the projected headlap portions in the preceding course are situated underneath the trailing edges of the shingles in the subsequent courses. This arrangement, according to the invention, would provide additional material overlap (i.e., an expanded overlap region) proximate to the trailing edge of a ship-lap joint.

Referring to FIGS. 7 and 8, it will be appreciated that the non-straight longitudinal front edges 7 of shingles 10 in a subsequently installed course create a continuous profile that undulates across the length of the shingle course by extending over portions of the headlap portions 2 of shingles 10 in the previously installed course (including the side-lap regions of shingles 10 in the previously installed course) and receding to expose a portion of the headlap portions 2 of shingles 10 in the previously installed course. The continuous undulating front edge profile of the installed shingles provides an improved aesthetic appearance. In preferred embodiments that have granules of contrasting color on the headlap portion, the aesthetic appearance of the shingles is further enhanced by creating the appearance of depth. This aesthetic appearance is even further enhanced by the third contrasting color on the buttlap projections. It will further be appreciated that the contrast between the first shade of granules and the second shade of granules creates a visible demarcation between the headlap portion and the buttlap portion, and that the projected horizontal buttlap portions may align with this visible demarcation. See FIG. 7, feature 701; FIG. 8, feature 801.

Although the shingles depicted in FIGS. 1-9 are single-layer shingles, it is contemplated that the principles disclosed herein may apply to laminated shingles, at least for the purposes of minimizing excess material, maximizing the exposure of the laminated shingle, and improving or maintaining weather performance compared to prior art laminated shingles.

The shingles of the invention may further comprise an alignment means, such as alignment notches or marks (not shown) on the lateral edges or a non-straight longitudinal rear edge of the shingle or sealant strips (not shown) on the topside of the headlap portion. In another embodiment, sealant strips (not shown) may be situated on the topside of shingle in the unexposed headlap portion. In this embodiment, the sealant strips (not shown) may serve as an alignment means for adjacently installed shingles in the same course and an alignment means for subsequently installed shingles in a subsequent course. However, it is not necessary for the sealant strips to serve as an alignment means. In other embodiments, the sealant strips may be placed on the underside of the buttlap portion of the shingles.

For one embodiment of the present invention, the shingle of the invention may be formed from a fiberglass mat (not shown) with an asphalt coating on both sides of the mat. If desired, the present invention may also be used with shingles formed from organic felt or other types of base material, including but not limited to synthetic mats or synthetic glass/hybrid mats having an appropriate coating. Nonlimiting embodiments of coatings include asphalt and modified bituminous coatings based on atactic polypropylene (APP), styrene-butadiane-styrene (SBS), styrene-ethylene-butadiene-styrene (SEBS), amorphous polyalpha olefin (APAO), thermoplastic polyolefin (TPO), synthetic rubber, their combinations, or other asphaltic modifiers.

The exposed outer surface or weather surface, i.e., the buttlap portion and portions of the headlap portion of the shingle of the invention, may be coated with various types of mineral granules to protect the asphalt coating, to add color to the shingle of the invention and to provide fire resistance. For some applications, ceramic-coated mineral granules may be disposed on the top surface of the buttlap portion. Also, a wide range of mineral colors from white and black to various shades of red, green, brown and any combination thereof may be used to provide a roof having the desired color for the shingle of the invention. In preferred embodiments, the headlap portion of shingle the of the invention may be coated with coatings that contrast with coatings applied to the buttlap portion of the shingle of the invention. See, e.g., FIG. 10. In particularly preferred embodiments, the buttlap projections of the shingle of the invention are coated with coatings that contrast with the coatings applied to the headlap portion and the buttlap portion of the shingle of the invention. See, e.g., FIGS. 1-9. In other embodiments, the entire outer surface of the shingle of the invention may be coated with any of the aforementioned coatings. The underside of the shingle of the invention may be coated with various inert minerals with sufficient consistency to seal the asphalt coating.

An important feature of the present invention includes providing a shingle having a reduced-width headlap portion. For the embodiment of the present invention shown in FIGS. 1-10, headlap portion 2 has a maximum headlap width ($W_H$) that is approximately 60% (e.g., 59.375%) of the maximum buttlap width ($W_B$) of shingle 10 of the invention. However, as noted above, the headlap portion may have a width that is 20% to 100% of the maximum buttlap width of the shingle of the invention.

Another important feature of the present invention includes providing a shingle with non-straight longitudinal edges having headlap projections and buttlap projections, wherein a leading headlap projection has an increased breadth. The shape and dimensions of the shingles of the invention operate to provide sufficient weather protection, i.e., by providing (a) a generally uniform overlap region between shingles in a previously installed course and shingles in a subsequently installed course and (b) an expanded overlap region proximate to a side-lap region between adjacently installed shingles in the subsequent course. The shingles of the invention allow for a reduction of materials because excess materials (e.g., additional overlap material) are minimized. In other words, more material of the shingle (i.e., surface area) is utilized in providing weather protection, which results in a relative increased exposure of each shingle. The relative increased exposure of each shingle allows for an overall reduction in materials necessary to cover a roof deck.

In a preferred embodiment, the exposure of the installed shingles of the invention may be between 65% and 71% of the total surface area of the shingle. In a particularly preferred embodiment, the exposure may be approximately 68% of the shingle. For the embodiments of the invention with an exposure of approximately 68%, approximately 147 $ft^2$ of roofing material is needed to cover 100 $ft^2$ of a roof deck.

The reduced-width headlap portion and the unique shape and/or dimensions of the shingle of the present invention are desirable because they allow for an improved utilization of materials that are required to make the shingles. In preferred embodiments of this invention, the shingles and roofing system of the present invention improve the material utilization over traditional, prior art 3-tab shingles preferably by between 36% and 42%, and more preferably by 39% (approximately 147 $ft^2$ of material needed for 100 $ft^2$ of coverage using shingles according to the instant invention versus 240 $ft^2$ of material for traditional, prior art 3-tab shingles).

The plurality of buttlap projections of the shingle of the present invention is desirable because it improves the aesthetics of the shingle when installed. The aesthetics of the shingle may further be enhanced, e.g., in a preferred embodiment, by surfacing the headlap portion with a first shade of granules that contrasts with a second shade of granules that surface the buttlap portion. In this embodiment, the contrasting colors of the exposed headlap portion and the buttlap portion may create a perceived increase in shingle depth. This visual effect may be further enhanced by surfacing the buttlap projections with a third shade of granules, and further yet when the first shade of granules is the darkest of the three shades and the third shade of granules is the lightest of the three shades. See, e.g., FIGS. 7 and 8.

The above-described methods of making the shingles of the invention may be employed at current strip shingle plants with little mechanical changes to the plants.

Although the present invention and its advantages have been described in detail, it should be understood that various changes, substitutions and alterations can be made therein without departing from the spirit and scope of the invention as defined by the appended claims.

What is claimed is:

1. A roofing shingle comprising:

a headlap portion, a buttlap portion, a lateral leading edge, and a lateral trailing edge;

wherein said buttlap portion includes a plurality of buttlap projections extending away from the shingle defining a maximum buttlap width and a plurality of recessed horizontal buttlap portions;

wherein each of said buttlap projections includes a horizontal edge defining a projected horizontal buttlap portion;

wherein each said projected horizontal buttlap portion has a primary horizontal breadth at the respective horizontal edge that is about equal for each said projected horizontal buttlap portion, and is about equal to a breadth of at least one of said recessed horizontal buttlap portions;

wherein said headlap portion includes a plurality of headlap projections extending away from the shingle defining a maximum headlap width and a plurality of recessed horizontal headlap portions;

wherein each of said headlap projections includes a horizontal edge defining a projected horizontal headlap portion;

wherein a first of said projected horizontal headlap portions is nearest to the lateral leading edge and has a horizontal breadth at said horizontal edge that is greater than the primary horizontal breadth; and wherein the horizontal breadth of the first of said projected horizontal headlap portions nearest to the lateral leading edge is greater than a breadth at said horizontal edge of at least another of said projected horizontal headlap portions and a breadth of at least one of said recessed horizontal headlap portions and said breadth of said at least another of said projected horizontal headlap portions is about equal to the primary horizontal breadth;

wherein the maximum headlap width is less than the maximum buttlap width; and wherein said headlap portion is surfaced with a first shade of granules and said buttlap portion is surfaced with a second contrasting shade of granules.

2. The roofing shingle according to claim 1, wherein the buttlap portion is further surfaced with a third further contrasting shade of granules on the buttlap projections.

3. The roofing shingle according to claim 1, wherein the maximum headlap width is approximately 60% of the maximum buttlap width.

4. The roofing shingle according to claim 1, wherein the buttlap projections have a height of about 2 inches.

5. The roofing shingle according to claim 4, wherein the headlap projections have a height of about 1¾ inches.

6. The roofing shingle according to claim 1, wherein the breadth of the first projected horizontal headlap portion nearest to the lateral leading edge is about 125% the primary horizontal breadth.

7. The roofing shingle according to claim 1, wherein the primary horizontal breadth is about 6 inches.

8. The roofing shingle according to claim 1, wherein at least one of said buttlap projections has a shape that mirrors one of the headlap projections laterally across the shingle.

9. The roofing shingle according to claim 1, wherein the shingle is single-layer.

10. A roofing system comprising a plurality of the roofing shingle according to claim 1, wherein the roofing system comprises a plurality of courses of said shingles, and wherein the lateral trailing edge of a subsequently installed at least one of said shingles in a first course of shingles overlaps the lateral leading edge of an adjacent one of said previously installed shingles in the first course to provide a side-lap region, and wherein the side-lap region forms a part of a partially side-lapped recessed horizontal buttlap portion having a breadth about equal to the primary horizontal breadth;

and wherein at least one of said shingles in a subsequent course of shingles provides:

(a) a generally uniform overlap region over the headlap portions of a first adjacent shingle and a second adjacent shingle in the first course; and (b) an expanded overlap region over the headlap portion of the second adjacent shingle, wherein the expanded overlap region is due to the increased projection breadth of the first headlap projection nearest to the lateral leading edge of the second adjacent shingle.

11. The roofing system according to claim 10, wherein a buttlap projection nearest to the trailing edge of said at least one of said shingles in the subsequent course of shingles overlaps the side-lap region between adjacent shingles in the first course.

12. The roofing system according to claim 10, wherein the buttlap portion is further surfaced with a third further contrasting shade of granules on the buttlap projections.

13. The roofing system according to claim 10, wherein at least one of said buttlap projections has a shape that mirrors one of the headlap projections laterally across said at least one of said shingles.

14. The roofing system according to claim 10, wherein the side-lap region has a breadth of about 3 inches.

15. A roofing system comprising:

single-layer shingles in more than one course wherein each of said shingles has a length, a headlap portion, a buttlap portion, a lateral leading edge, and a lateral trailing edge;

wherein said buttlap portion includes a plurality of buttlap projections extending away from the shingle defining a maximum buttlap width;

wherein the buttlap projections have a breadth that is about equal for each buttlap projection defining a primary projection breadth opposite a primary horizontal breadth at a horizontal edge;

wherein said headlap portion includes a plurality of headlap projections extending away from the shingle defining a maximum headlap width;

wherein a first of said headlap projections nearest to the lateral leading edge has an increased projection breadth that is greater than the primary projection breadth, and the increased projection breadth of the first of said headlap projections nearest to the lateral leading edge is greater than a breadth of at least another of said headlap projections: and wherein said breadth of said at least another of said headlap projections is about equal to the primary projection breadth;

wherein the maximum headlap width is less than the maximum buttlap width;

wherein the roofing system comprises a plurality of courses of said shingles, and wherein the lateral trailing edge of a subsequently installed at least one of said shingles in a first course of shingles overlaps the lateral leading edge of an adjacent previously installed one of said shingles in the first course to provide a side-lap region;

and wherein at least one of said shingles in a subsequent course of shingles provides:

(a) a generally uniform overlap region over the headlap portions of a first adjacent shingle and a second adjacent shingle in the first course, wherein the generally uniform overlap region has a transverse dimension that varies by less than 10% across the length of shingle in the subsequent course; and (b) an expanded overlap region over the headlap portion of the second adjacent shingle, wherein the expanded overlap region is due to the increased projection breadth of the first headlap projection nearest to the lateral leading edge of the second adjacent shingle.

16. The roofing system according to claim 15, wherein the buttlap projections and the headlap projections have a trapezoidal shape.

17. The roofing system according to claim 16, wherein the buttlap projections have a minimum breadth that extends away from the shingle, and wherein the headlap projections have a minimum breadth that extends away from the shingle.

18. The roofing system according to claim 15, wherein a buttlap projection nearest to the trailing edge of the shingle in the subsequent course of shingles overlaps the side-lap region between adjacent shingles in the first course.

19. The roofing system according to claim 15, wherein said headlap portion is surfaced with a first shade of granules and said buttlap portion is surfaced with a second contrasting shade of granules.

20. The roofing system according to claim 19, wherein the buttlap portion is further surfaced with a third further contrasting shade of granules on the buttlap projections.

21. The roofing system according to claim 15, wherein at least one of said buttlap projections has a shape that mirrors one of the headlap projections laterally across the shingle.

22. The roofing system according to claim 15, wherein the side-lap region has a breadth of about 3 inches.

23. A roofing shingle comprising:

headlap portion, a buttlap portion, a lateral leading edge, and a lateral trailing edge;

wherein said buttlap portion includes a plurality of buttlap projections extending away from the shingle defining a maximum buttlap width and a plurality of recessed horizontal buttlap portions;

wherein each of said buttlap projections includes a horizontal edge defining a projected horizontal buttlap portion;

wherein each said projected horizontal buttlap portion has a horizontal buttlap breadth that differs from each other by between 0% and 20%, and differs from a breadth of at least one of said recessed horizontal buttlap portions by between 0% and 20%, and wherein at least one of said projected horizontal buttlap portions has a maximum horizontal buttlap breadth;

wherein said headlap portion includes a plurality of headlap projections extending away from the shingle defining a maximum headlap width and a plurality of recessed horizontal headlap portions;

wherein each of said headlap projections includes a horizontal edge defining a projected horizontal headlap portion;

wherein a first of said projected horizontal headlap portions is nearest to the lateral leading edge and has a maximum horizontal breadth that is greater than the maximum horizontal buttlap breadth, and wherein the maximum horizontal breadth of the first of said projected horizontal headlap portions nearest to the lateral leading edge is greater than a maximum breadth of at least another of said projected horizontal headlap portions and at least one of said recessed horizontal headlap portions has a breadth that differs from the horizontal buttlap breadth of each of the projected horizontal buttlap portions by between 0% and 20%;

wherein the maximum headlap width is less than the maximum buttlap width; and wherein said headlap portion is surfaced with a first shade of granules and said buttlap portion is surfaced with a second contrasting shade of granules.

* * * * *